US005649764A

United States Patent [19]

Strickland

[11] Patent Number: 5,649,764

[45] Date of Patent: Jul. 22, 1997

[54] LAMP BASE AND LAMP BASE KIT

[75] Inventor: Jerry D. Strickland, Jonesboro, Ark.

[73] Assignee: Mastercraft Lamp Co., Inc., West Memphis, Ark.

[21] Appl. No.: 348,300

[22] Filed: Dec. 2, 1994

[51] Int. Cl.[6] ..... F21S 1/12

[52] U.S. Cl. ..... 362/410; 362/414; 362/431; 403/13; 403/388

[58] Field of Search ..... 362/410, 414, 362/431; 248/188, 188.7; 403/13, 387, 388

[56] References Cited

U.S. PATENT DOCUMENTS

| | | | |
|---|---|---|---|
| 1,456,194 | 5/1923 | Rosenberg . | |
| 2,429,553 | 10/1947 | Jasinski | 362/410 |
| 2,521,355 | 9/1950 | Ford | 248/121 |
| 4,562,521 | 12/1985 | Noguchi | 362/433 |

FOREIGN PATENT DOCUMENTS 822795 10/1959 United Kingdom .

*Primary Examiner*—Denise L. Gromada
*Assistant Examiner*—Sara Sachie Raab
*Attorney, Agent, or Firm*—Walker, McKenzie & Walker, P.C.

[57] ABSTRACT

A lamp base and a lamp base kit having component parts capable of being compactly packaged and quickly and easily assembled into a lamp base by a customer. The lamp base kit includes three separate connectors respectively having internally threaded openings therein and includes a pair of tubes respectively having externally threaded portions on the ends thereof which are adapted to respectively threadedly engage with the threaded openings in the connectors when the lamp base is assembled to establish a pole. The lamp base further includes a stand, and a lamp and shade holder which respectively have fixedly attached thereto one of the connectors. The stand includes three disconnected legs and a mounting hub. Each of the legs has a recessed socket and a hole through one end thereof. The recessed sockets of the legs are adapted to respectively receive pins which are fixedly attached to the hub. Each of the legs in addition has a hole therethrough. The holes in the legs are adapted to respectively receive screws to hold the legs in place. Also, the lamp base includes an electrical conductor preassembled with the lamp base so that the pole may be assembled by the customer quickly and easily by rotating the threaded end portions of the tubes into the threaded openings in the connectors. Also, the stand may be quickly and easily assembled by threading the three screws into the three threaded sockets in the hub.

9 Claims, 2 Drawing Sheets

LAMP BASE AND LAMP BASE KIT

BACKGROUND OF THE INVENTION

1. Field of the Invention

The present invention relates, in general, to a lamp base of the knock-down type and a lamp base kit.

2. Information Disclosure Statement

Heretofore, in knock-down types of lamp bases, a problem has existed due to the large size of the packaging necessary to package the lamp bases. This problem occurs because of the amount of space necessary to package a lamp base stand having legs permanently fixedly attached to the lamp pole. These previous large size packages or boxes resulted in the necessity of an increased amount of storage space in the warehouse in which the boxes were stored and increased shipping costs due to the bulky boxes. In addition, there were problems with these previous boxes in the stores where sold since they could not be conveniently displayed on shelves because of their size. Thus, there is a need to have a lamp base of smaller size when in the knock-down condition, which can be packaged in small boxes for shelf display, and which are more economical to ship and to store in warehouses. Also, there is a need to have a lamp base kit which the customer can assemble easily and quickly into the assembled lamp base ready to use and without having to make any electrical connections in the lamp base itself.

A preliminary patentability search in Class 362, subclasses 410, 413, 414, and 431, produced the following patents, some of which may be relevant to the present invention: Rosenberg, U.S. Pat. No. 1,456,194, issued May 22, 1923; Ford, U.S. Pat. No. 2,521,355, issued Sep. 5, 1950; Noguchi, U.S. Pat. No. 4,562,521, issued Dec. 31, 1985; and British Patent No. 822,795, published Oct. 28, 1959. None of these references disclose or suggest the present invention.

SUMMARY OF THE INVENTION

The present invention is an improved lamp base of the knock-down type, in which the disassembled lamp base has the component parts thereof packaged together as a kit in a package much smaller than hereto possible due to the unique construction of the lamp base, and which kit is adapted to be quickly and easily assembled into an operable lamp base by a customer without having to connect any electrical conductors in the lamp base.

It is an object of the present invention to provide an improved lamp base which includes three separate connectors, respectively having internally threaded openings therein, and includes a pair of tubes respectively having externally threaded portions on the ends thereof that are adapted to respectively threadedly engage the threaded openings in the connectors, whereby the pole of the lamp base is easily and quickly assembled by the customer simply by rotating the pair of tubes relative to the connectors.

A further object is to include in the lamp base kit an electrical conductor preassembled with the lamp base which loosely extends through openings in the lamp base, from the light socket to the lamp plug, so that the lamp base is ready to be plugged in to an electrical outlet, and yet does not interfere with the assembly by the customer during rotating of the tubes relative to the connectors.

A further object is to provide an improved lamp base stand which includes, a mounting hub, a plurality of separate legs when in the disassembled condition, and means for detachably mounting the legs onto the mounting hub during the assembly of the lamp base by the customer.

DESCRIPTION OF THE PREFERRED EMBODIMENT

Figure 1:
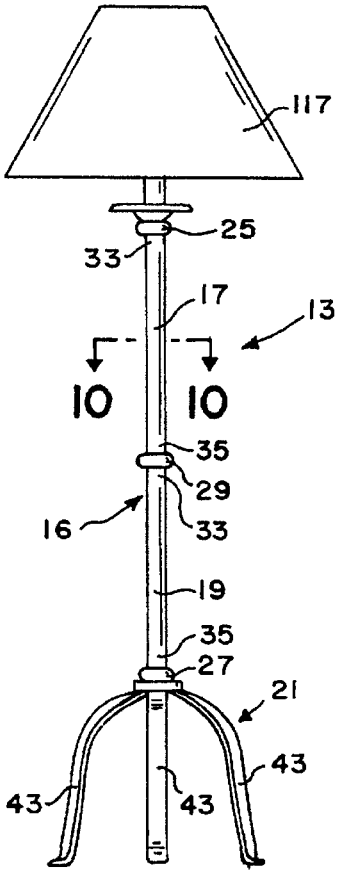
FIG. 1 is a front elevational view of the lamp base of the present invention shown in an assembled condition and with a lamp shade thereon.
Figure 2:
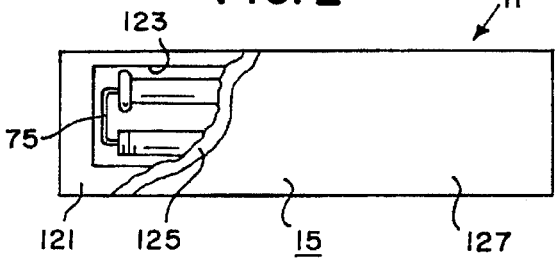
FIG. 2 is plan view of the lamp base of FIG. 1 in a disassembled condition and with the component parts of the lamp base packaged together as a kit, and with parts of the package broken away for purposes of illustration.
Figure 3:
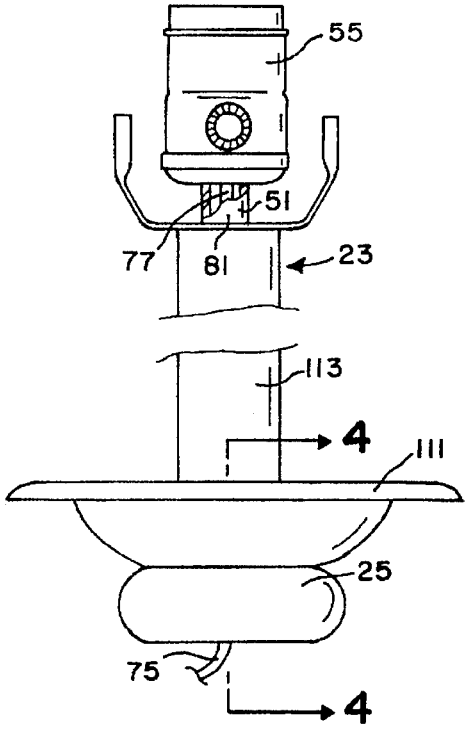
FIG. 3 is an enlarged front elevational view of the lamp and shade holder of the lamp base, with the first connector attached thereto, and with a portion of the holder broken away for purposes of illustration.
Figure 4:
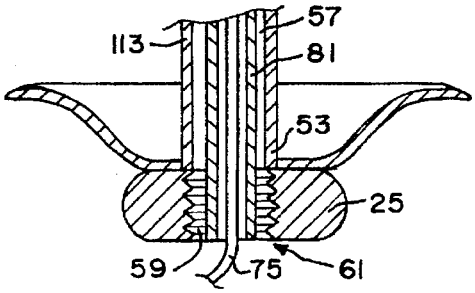
FIG. 4 is a fragmentary sectional view taken as on the line 4—4 of FIG. 3.
Figure 5:
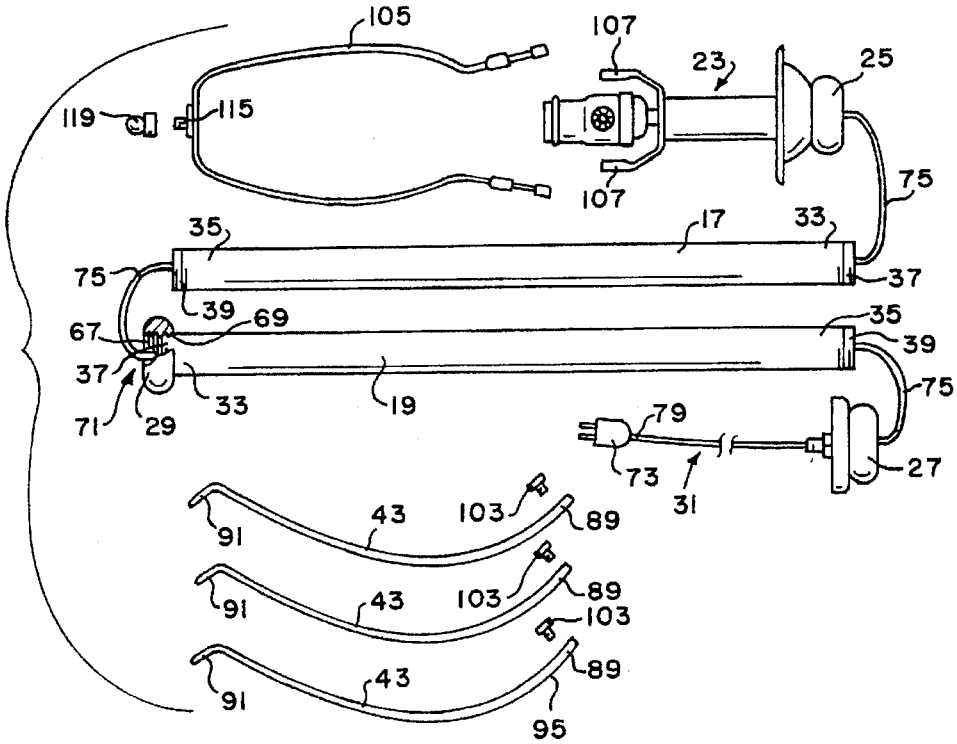
FIG. 5 is an exploded view of the components of the lamp base of the present invention and with a portion of the third connector being broken away for purposes of illustration.
Figure 6:
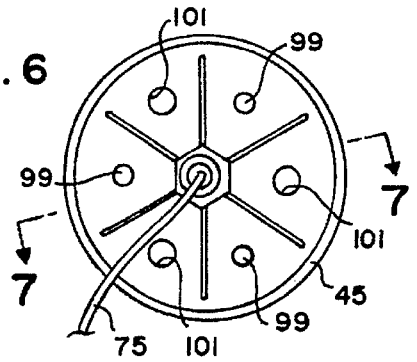
FIG. 6 is an enlarged bottom view of the mounting hub and attached connector of the lamp base of the present invention.
Figure 7:
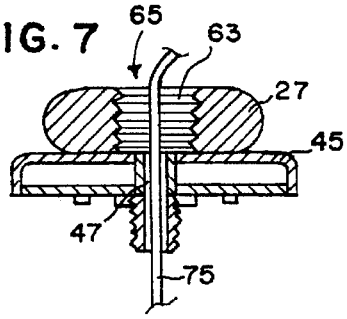
FIG. 7 is a sectional view of the mounting hub and attached connector taken as on the line 7—7 of FIG. 6.
Figure 8:
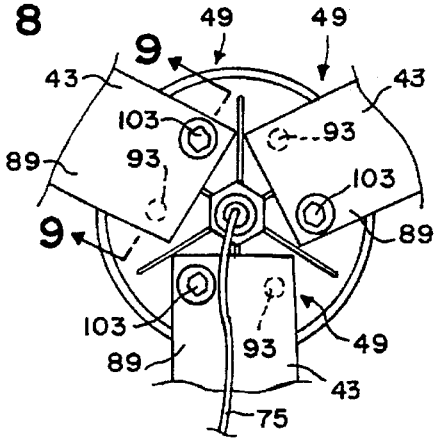
FIG. 8 is a bottom view similar to FIG. 6, in assembled relationship with the legs of the lamp base, and with the legs being broken away for purposes of illustration.
Figure 9:
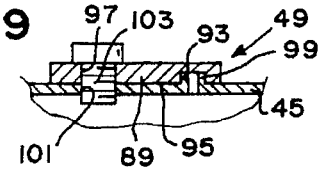
FIG. 9 is an inverted sectional view taken as on the line 9—9 of FIG. 8.
Figure 10:
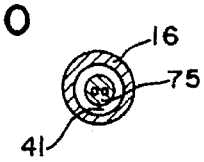
FIG. 10 is an enlarged sectional view taken as on the line 10—10 of FIG. 1.

Referring now to the drawings, lamp base kit 11 includes in general, a lamp base 13 and a package 15 containing the lamp base 13 in a disassembled condition.

Lamp base 13 comprises, in general, a pole 16, which pole in the principal embodiment comprises a pair of tubes including a first tube 17 and a second tube 19, a stand 21, a lamp and shade holder 23, a first connector 25, a second connector 27, a third connector 29, and an electrical conductor means 31. It should be understood that when pole 16 includes a pair of tubes 17, 19, the lamp base 13 is primarily for use as a floor lamp, but, if desired and without departing from the spirit and scope of the present invention, one of the tubes 17, 19 may be omitted so that pole 16, and consequently lamp base 13, will be shorter in height and therefore adapted for use as a table lamp.

First tube 17 and second tube 19 are substantially identical and the following description of first tube 17 will suffice for both. Also, the same numerals will be used to identify substantially similar parts of the two tubes 17, 19. Tube 17 has a first end 33 and a second end 35. First end 33 has an externally threaded portion 37 thereon and second end 35 has an externally threaded portion 39 thereon. First tube 17 has an elongated opening 41 which extends longitudinally continuously through first tube 17 and through first and second ends 33, 35.

Stand 21 includes a plurality of legs 43 (preferably three in number), a mounting hub 45 having an opening 47 therethrough, and coupling means 49 removably mounting each of legs 43 onto hub 45.

Lamp and shade holder 23 has an upper end 51 and a lower end 53. Holder 23 includes a light socket 55 at the upper end 51 thereof. Holder 23 has an elongated opening 57 extending from light socket 55 downwardly through holder 23 and through the lower end 53 thereof.

First connector 25 is substantially donut shaped and has an internally threaded portion or threaded socket 59 therein that establishes an opening 61 extending through first connector 25. Threaded socket 59 is threadedly mated with threaded portion 37 on first end 33 of first tube 17. First connector 25 is fixedly attached by suitable means, as by welding or the like, to lamp and shade holder 23 adjacent the lower end 53 thereof, with opening 61 in first connector 25 being aligned with opening 57 in holder 23.

Second connector 27 is substantially similar to first connector 25, and has an internally threaded portion or threaded socket 63 threadedly mated with the threaded portion 39 on second end 35 of second tube 19 when two tubes 17, 19 are used. Second connector 27 has an opening 65 extending therethrough. Second connector 27 is fixedly attached by suitable means, as by welding or the like, to mounting hub 45 with opening 65 in second connector 27 being aligned with opening 47 in mounting hub 45. It will be understood that when only one of the tubes 17, 19 is used, as when lamp base 13 is used as a table lamp, the second end 35, of the particular one of the tubes 17 or 19 that is used, will become the second end or lower end of pole 16, and will be threadedly mated with the threaded socket 63 in second connector 27.

When both tubes 17, 19 are used, it is necessary to use a third connector 29, which has a first internally threaded portion or socket 67 threadedly mated with the threaded portion 39 on the second end 35 of first tube 17, and which has a second internally threaded portion or socket 69 threadedly mated with the threaded portion 37 on the first end 33 of second tube 19.

Electrical conductor means 31 is preferably of a construction well known to those skilled in the art, and includes an electrical plug 73 and an electrical conductor 75 having a first end 77 and a second end 79. Conductor 75 is electrically connected, in a manner well known to those skilled in the art, to light socket 55 at the first end 77 of conductor 75, and to electrical plug 73 at second end 79 of conductor 75, and loosely successively extends from light socket 55 through elongated opening 57 in lamp and shade holder 23, through opening 61 in first connector 25, through elongated opening 41 in first tube 17, through opening 71 in third connector 29, through elongated opening 41 in second tube 19, through opening 65 in second connector 27, through opening 47 in mounting hub 45, and extends to the connection with electrical plug 73, which is adapted to be connected to a source of electrical power in a manner well known to those skilled in the in art, as by an outlet or receptacle, not shown. A pipe 81 preferably surrounds the portion of electrical conductor 75 which extends through opening 57 in holder 23 and through opening 61 in first connector 25.

Legs 43 are substantially identical in construction, and each of the coupling means 49 for respectively coupling legs 43 to mounting hub 45 are identical and the following description of one leg 43 and one of the coupling means 49 for coupling one leg 43 will suffice for all. Each leg 43 includes a first end 89 and a second end 91. Each of the coupling means 49 comprises a recessed first socket 93 in the upper side 95 of leg 43 adjacent the first end 89 thereof, and a smooth bore hole 97 through leg 43 adjacent the first end 89 and laterally spaced from socket 93. In addition, each coupling means 49 includes a pin 99, corresponding to recessed socket 93, that is fixedly attached to mounting hub 45 and extends downwardly therefrom and is removably received in recessed socket 93. Also, each of the coupling means 49 includes a threaded second socket 101 in mounting hub 45, corresponding to hole 97 in first end 89 of leg 43 and is aligned therewith; and also includes a screw 103, removably extending through hole 97 in first end 89 of leg 43 and mated with threaded socket 101 in mounting hub 45.

Lamp and shade holder 23, in addition to light socket 55, preferably includes a well known harp 105 which is supported by brackets 107 into which the lower ends of harp 105 removably fit in the usual manner. Also, holder 23 includes suitable well known supporting structure such as the upper end of pipe 81 to which light socket 55 is attached. Pipe 81 is also attached to brackets 107 and, as desired, to other portions of holder 23, by suitable means well known to those skilled in the art. In addition, holder 23 includes a typical candle plate 111 and candlestick 113 simulating a candlestick and holder. At the top of harp 105 is preferably provided the usual threaded stud 115 for attaching a lamp shade, as for example, lamp shade 117, by the usual internally-threaded nut-like retainer 119.

Package 15 preferably includes a box-like inner package 121, formed of polystyrene or the like, which has recesses 123 therein that contain the various components of the disassembled lamp base 13, namely, tubes 17, 19, stand 21 (in disassembled condition), lamp and shade holder 23, first connector 25, second connector 27, third connector 29, and electrical conductor means 31. The electrical conductor 75 is pre-assembled at the lamp factory in the lamp base 13 so that, in the packaged state in package 15, the electrical conductor 75 is connected at the respective ends thereof, as previously described, to light socket 55 and electrical plug 73 so that no assembly of the electrical conductor means 31 is necessary by the user, and thus the lamp base 13 can be quickly and easily assembled as described later in this specification. Inner package 121 also includes a rectangular top 125 formed of polystyrene or the like. The inner package 121 is received in an outer package 127 which is preferably formed of cardboard or the like, and the dimensions of which are less than 21 ½ inches by 7 ½ inches by 5 inches (54.6 cm by 19 cm by 12.7 cm), and specifically, approximately 21 ⅛ inches by 7 ⅛ inches by 4 ⅞ inches (approximately 53.7 cm by 18.1 cm by 12.4 cm). It will be understood that a lamp shade is not included in this particular compact package 15, and therefore the customer can create his or her own unique lamp by combining a lamp base 13 with a designer shade of the customer's own choice. Also, it will be understood that third connector 29 is preferably already threadedly assembled at the factory on the first end 33 of second tube 19 so that such assembly will not have to be done by the customer.

In assembling lamp base 13 from the lamp base kit 11 of the present invention, only the following few steps by the customer are necessary:

After the parts are removed from package 15, the three legs 43 are attached to the mounting hub 45 by means of the screws 103. Then, without having to use any tools, second end 35 of second tube 19 is threadedly engaged with second connector 27, second end 35 of first tube 17 is threadedly engaged with third connector 29, first end 33 of first tube 17 is threadedly engaged with first connector 25, and harp 105 is engaged with brackets 107 to complete lamp base 13. The lamp is then completed by screwing a bulb in socket 55 and placing a lamp shade on harp 105.

Although the present invention has been described and illustrated with respect to a preferred embodiment and a preferred use therefor, it is not to be so limited since modifications and changes can be made therein which are within the full intended scope of the invention.

I claim:

1. A lamp base kit having component parts capable of being compactly packaged and quickly and easily assembled into a lamp base by a consumer, the kit comprising, in combination:

(a) a pole having a first end and a second end, each of said first and second ends having a threaded portion thereon, said pole having a elongated opening longitudinally there through and extending through said first end and said second end;

(b) a stand, said stand including:

i. a plurality of disconnected legs, ii. a mounting hub having an opening therethrough, and iii. coupling means for fixedly mounting each of said legs onto said hub;

(c) a lamp and shade holder having a lower end, said holder including a light socket, said holder having an elongated opening extending from said light socket downwardly through said holder and through the lower end of said holder;

(d) a first connector having a threaded portion adapted to threadedly mate with the threaded portion on the first end of said pole, said first connector having an opening extending therethrough, and said first connector being fixedly attached to said lamp and shade holder adjacent the lower end thereof with the opening in said first connector being aligned with the opening in said holder;

(e) a second connector having a threaded portion adapted to threadedly mate with the threaded portion on the second end of said pole, said second connector having an opening extending therethrough, and said second connector being fixedly attached to said mounting hub with the opening in said second connector being aligned with the opening in said mounting hub; and (f) electrical conductor means for supplying electrical power to said light socket, including:

i. an electrical plug; and ii. an electrical conductor having a first end and a second end, said conductor being electrically connected to said light socket at the first end of said conductor and to said electrical plug at the second end of said conductor and loosely successively extending from said light socket through the elongated opening in said lamp and shade holder, through the opening in said first connector, through the elongated opening in said pole, through the opening in said second connector, through the opening in said mounting hub, and extending to the connection with said electrical plug.

2. The lamp base kit of claim 1 in which each of said legs includes a first end and a second end and in which said each of said coupling means for fixedly mounting each of said legs onto said mounting hub includes:

(a) a recessed socket in said first end of each of said legs and a hole through said first end of each of said legs;

(b) a pin corresponding to said recessed socket, said pin being attached to and extending downwardly from said mounting hub and adapted to be received in said recessed socket when assembled with said mounting hub;

(c) a threaded socket in said hub corresponding to said hole in said first end of said leg and adapted to be aligned with said hole in said first end of said leg when moved into position to be assembled with said mounting hub; and (d) a screw adapted to extend through said hole in said first end of said leg and matingly threadable into said threaded socket when said hole in said first end of said leg is moved into said position to be assembled with said mounting hub.

3. The lamp base kit of claim 1 in which said pole includes a pair of tubes and a third connector adapted to connect said pair of tubes together in end-to-end relationship when said lamp base is assembled.

4. The lamp base kit of claim 3 which includes a package in which said pair of tubes, said stand, said lamp and shade holder, said first connector, said second connector, said third connector, and said electrical conductor means are compactly packaged when said lamp base is unassembled.

5. The lamp base kit of claim 4 in which the dimensions of said package are less than 21½ inches by 7½ inches by 5 inches.

6. In a lamp base, a lamp base stand comprising:

(a) a plurality of legs, each said leg including a first end;

(b) a mounting hub having a bottom; and (c) like plurality of coupling means respectively operably coupled to said first end of each said leg and to said mounting hub for respectively detachably mounting said first end of each said leg to the bottom Of said mounting hub, each of said coupling means including:

i. vertically extending pin mounted on one of each said leg or said mounting hub, and the other of each said leg or said mounting hub having a vertically extending first socket for receiving said pin;

ii. a vertically extending threaded second socket provided in one of each said leg or said mounting hub, and the other of each said leg or said mounting hub having a vertically extending hole vertically aligned with said second socket; and iii. a screw removably extending vertically through said hole and threadedly engaged in said threaded socket, said screw being laterally spaced from said pin.

7. In a lamp base, a lamp base stand comprising:

(a) a plurality of legs, each of said legs including a first end and a second end;

(b) a mounting hub; and (c) coupling means operably coupled to said legs and to said mounting hub for detachably mounting said legs to said mounting hub, said coupling means comprising:

i. a vertically extending recessed socket in said first end of each of said legs and a vertically extending hole through said first end of each of said legs, said hole being laterally spaced from said recessed socket;

ii. a plurality of vertically extending pins respectively corresponding to the recessed sockets, said pins being respectively attached to and extending downwardly from said mounting hub and respectively removably received in the recessed sockets;

iii. a plurality of vertically extending threaded sockets in said mounting hub respectively corresponding to the holes in the first ends of said legs and aligned therewith; and iv. a plurality of vertically extending screws respectively removably extending through the holes in the first ends of said legs and matingly threadable into the threaded sockets in said mounting hub.

8. A lamp base comprising:

(a) a pair of tubes including a first and a second tube, each of said tubes respectively having first and second ends having threaded portions thereon, each of said tubes having an elongated opening longitudinally therethrough and extending through said first end and said second end of each of said tubes;

(b) a stand, said stand including:

i. a plurality of legs, ii. a mounting hub having an opening therethrough, and iii. coupling means for removably mounting each of said legs onto said hub;

(c) a lamp and shade holder having a lower end, said holder including a light socket, said holder having an elongated opening extending from said light socket downwardly through said holder and through the lower end of said holder;

(d) a first connector having a threaded portion threadedly mated with the threaded portion on the first end of said first tube, said first connector having an opening extending therethrough, and said first connector being fixedly attached to said lamp and shade holder adjacent the lower end thereof with the opening in said first connector being aligned with the opening in said holder;

(e) a second connector having a threaded portion threadedly mated with the threaded portion on the second end of said second tube, said second connector having an opening extending therethrough, and said second connector being fixedly attached to said mounting hub with the opening in said second connector being aligned with the opening in said mounting hub;

(f) a third connector having a first threaded portion threadedly mated with the threaded portion on the second end of said first tube, and having a second threaded portion threadedly mated with the threaded portion on the first end of said second tube, and said third connector having an opening extending therethrough; and (g) electrical conductor means for supplying electrical power to said light socket including:

i. an electrical plug; and ii. an electrical conductor having a first end and a second end, said conductor being electrically connected to said light socket at the first end of said conductor and to said electrical plug at the second end of said conductor and loosely successively extending from said light socket through the elongated opening in said lamp and shade holder, through the opening in said first connector, through the elongated opening in said first tube, through the opening in said third connector, through the elongated opening in said second tube, through the opening in said second connector, through the opening in said mounting hub, and extending to the connection with said electrical plug.

9. The device of claim 8 in which each of said legs includes a first end and a second end, and in which said coupling means comprises:

(a) a recessed socket in said first end of each of said legs and a hole through said first end of each of said legs;

(b) a plurality of pins respectively corresponding to the recessed sockets, said pins being respectively attached to and extending downwardly from said mounting hub and respectively removably received in the recessed sockets;

(c) a plurality of threaded sockets in said hub respectively corresponding to the holes in the first ends of said legs and aligned therewith; and (d) a plurality of screws respectively removably extending through the holes in the first ends of said legs and matingly threadable into the threaded sockets in said mounting hub.

* * * * *